United States Patent [19]

Watanabe et al.

[11] Patent Number: 4,936,925

[45] Date of Patent: Jun. 26, 1990

[54] METHOD FOR PRODUCING ALLOY OF LOW THERMAL EXPANSION

[75] Inventors: Tuyuki Watanabe, Shizuoka; Toshiyuki Oohashi, Hamamatsu, both of Japan

[73] Assignee: Yamaha Corporation, Japan

[21] Appl. No.: 389,169

[22] Filed: Aug. 3, 1989

Related U.S. Application Data

[63] Continuation-in-part of Ser. No. 229,783, Aug. 5, 1988, abandoned, which is a continuation of Ser. No. 884,062, Jul. 10, 1986, abandoned.

[30] Foreign Application Priority Data

Jul. 26, 1985 [JP] Japan ..... 60-165050

[51] Int. Cl.[5] ..... C21D 8/00

[52] U.S. Cl. ..... 148/12 R; 148/12 A; 148/336

[58] Field of Search ..... 148/12 R, 12 A, 336, 148/337; 420/95, 120

[56] References Cited

U.S. PATENT DOCUMENTS 2,470,653 5/1949 Schulman et al. ..... 148/336

FOREIGN PATENT DOCUMENTS 198741 11/1984 Japan ..... 420/95
27518 2/1987 Japan ..... 148/336
364696 1/1932 United Kingdom ..... 420/95

*Primary Examiner*—John P. Sheehan
*Assistant Examiner*—George Wyszomierski
*Attorney, Agent, or Firm*—Lerner, David, Littenberg, Krumholz & Mentlik

[57] ABSTRACT

In production of alloy for lead frames used in semiconductor integration circuits, a Fe-base alloy of a specified composition is annealed at a temperature above its recrystallization point and, thereafter, worked at 13 to 40% degree of working in order to subject the resultant elongation by thermal expansion close to those of Si, SiC and $Si_3N_4$ over wide range of temperature.

4 Claims, 7 Drawing Sheets

METHOD FOR PRODUCING ALLOY OF LOW THERMAL EXPANSION

CROSS-REFERENCE TO RELATED APPLICATIONS

This is a continuation-in-part application of U.S. Ser. No. 07/229,783 filed Aug. 5, 1988, now abandoned, which was a continuation application of U.S. Ser. No. 06/884,062 filed July 10, 1986, now abandoned.

BACKGROUND OF THE INVENTION

The present invention relates generally to an improved method for producing alloy of low thermal expansion, and more particularly to an improvement in production of an Fe-base alloy well suited for production of lead frames used for semiconductor integration circuits.

Fe-Ni type 42 alloy, 54Fe-29Ni-17Co type Fernico alloy and Fe-Ni-Co type alloy disclosed in Japanese Patent Opening No. sho.59-198741 are well known as alloys of low thermal expansion.

The Fe-Ni type 42 alloy has a low magnetic transformation point in a range from 300° to 350° and exhibits extremely large elongation by thermal expansion in the temperature range above the magnetic transformation point. This elongation is by far larger than that of Si forming silicon chips, and when the lead frame of a semiconductor integration circuit is made of the Fe-Ni type 42 alloy, such a big difference in elongation imposes thermal stress on silicon chips in the integration circuit due to thermal expansion and shrinkage of the lead frames at excitation and deexcitation of the integration circuit.

Although the 54Fe-29Ni-17Co type Fernico alloy has a relatively high magnetic transformation point, its elongation by thermal expansion is significantly larger than of Si in the temperature range below the magnetic transformation point. When the lead frame of a semiconductor integration circuit is made of the 54Fe-29Ni-17Co type Fernico alloy, such a big difference in elongation also imposes thermal stress on silicon chips in the temperature range below the magnetic transformation point at excitation of the integration circuit.

The above-described Fe-NiCo type alloy exhibits elongation by thermal expansion closer to that of Si than the Fe-Ni type 42 alloy and the 54Fe-29Ni17Co type Fernico alloy in the high temperature range, and thermal stress imposed the silicon chips in the integration circuit is extremely small. Nevertheless, the alloy undergoes transformation in the temperature range below the room temperature and its thermal expansion varies greatly in the low temperature range. As a consequence, use of this alloy also imposes thermal stress on the silicon chips in the integration circuit in the low temperature range.

SUMMARY OF THE INVENTION

It is the object of the present invention to provide improved method for producing Fe-base alloy which exhibits low thermal expansion in both low and high temperature ranges and has elongation by thermal expansion very close to those of Si, SiC and $Si_3N_4$.

To this end, in the method of the present invention annealing is applied to a Fe-base alloy at a temperature above the recrystallization point of the Fe-base alloy which contains 25 to 32% by weight of Ni, 10 to 15% by weight of Co, 0.1 to 2% by weight of Mn, 1% by weight or less of Si, 0.001 to 0.5% by weight of C and Fe in balance. The Fe-base alloy is then subjected to cold working at 13 to 40% degree of working.

DESCRIPTION OF THE PREFERRED EMBODIMENTS

Figure 1:
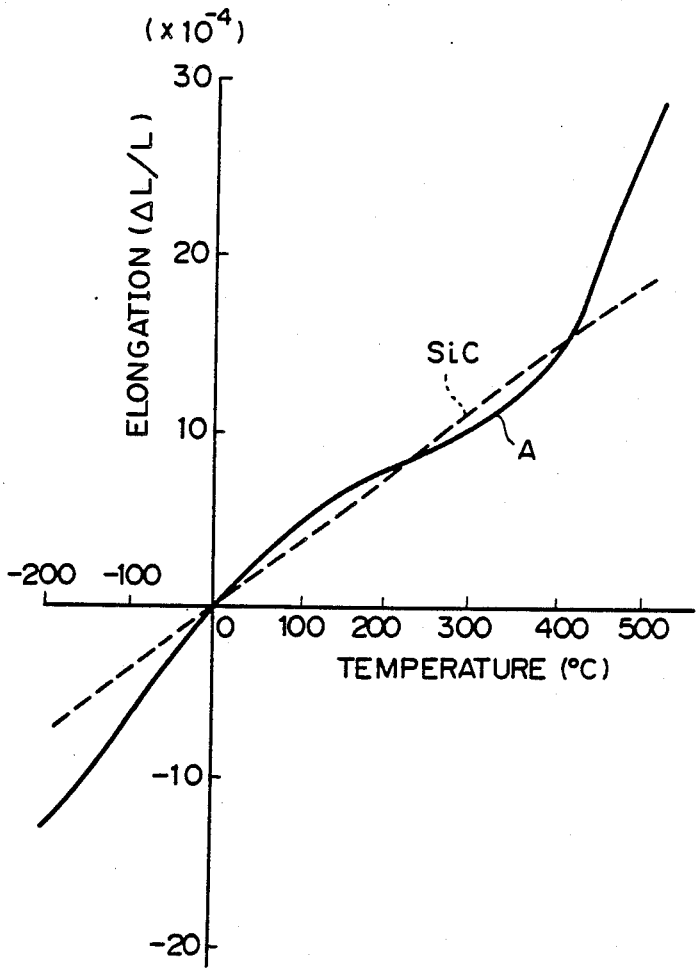
FIG. 1 is a graph for showing elongations of a lowly expansible alloy A and SiC.

In accordance with the method of the present invention, annealing is applied to a Fe-based alloy containing 25 to 32% by wight of Ni, 10 to 15% by weight of Co, 0.1 to 2% by weight of Mn, 1% by weight or less of Si, 0.001 to 0.5% by weight of C and Fe in balance. Here, Mn, Si and C are contained for stable alloy structure. Next, forging, hot rolling and grinding are applied in sequence to the Fe-base alloy to produce a plate material. Further, cold rolling and bright annealing are alternately applied to the plate material for 3 to 4 times. The cold rolling is carried out preferably at 50 to 80% degree of working. The bright annealing is carried out in a temperature range from 700° to 1,100° C. for a period from 1 to 240 minutes. After heating, the plate material is cooled either abruptly or slowly. The optimum annealing temperature is slightly higher than the recrystallization point of the Fe-base alloy. For example, bright annealing is carried out at 1,000° C. for 1 minute or at 800° C. for 240 minutes. This bright annealing removes working hysteresis developed in the Fe-base alloy during the cold rolling for uniform structure of the end product.

Next, the plate material is subjected in sequence to cold rolling and annealing. The cold rolling is carried out at 13 to 40% degree of working. When the degree of working is set below 13%, significant rise in thermal expansion in the low temperature range (−196° to 0° C.). Whereas any degree of working above 40% would cause increased expansion. Annealing is carried out in a temperature range from 580° to 680° C. for 0.5 to 3.0 minutes. Either abrupt or slow cooling is followed. The optimum annealing temperature is slightly lower than the recrystallization point of the Fe-base alloy. Examples:

TABLE 1

| alloy plate | % By Weight | | | | | |
|---|---|---|---|---|---|---|
| | Ni | Co | Mn | Si | C | Fe |
| A | 30.4 | 14.0 | 0.27 | 0.09 | 0.14 | balance |
| B | 29.9 | 14.0 | 0.27 | 0.09 | 0.009 | balance |
| C | 30.1 | 13.1 | 0.22 | 0.10 | 0.014 | balance |

In preparation of each alloy plate, corresponding Fe-base alloy was subjected to forging, hot rolling at 120° C. temperature and 80% degree of working and grinding. Thereafter the Fe-base alloy was subjected to alternate two times of application of cold rolling at 50 to 90% degree of cross sectional surface reduction and bright annealing at 1,000° C. for 1 minute in neutral gas or vacuum atmosphere. The Fe-base alloy was further subject to cold working at 14% degree of working and annealing by heating at 620° C. for 1 minute followed by slow cooling.

Average coefficients of thermal expansion of the alloy plates A, B and C are shown in Table 2.

TABLE 2

| Temperature in °C. | 30~250 | 30~300 | 30~350 | 30~400 | 30~450 | 30~500 |
|---|---|---|---|---|---|---|
| A | 36 | 35 | 35 | 38 | 48 | 59 |
| B | 31 | 30 | 30 | 35 | 47 | 57 |
| C | 27 | 26 | 27 | 34 | 45 | 55 |

Figure 2:
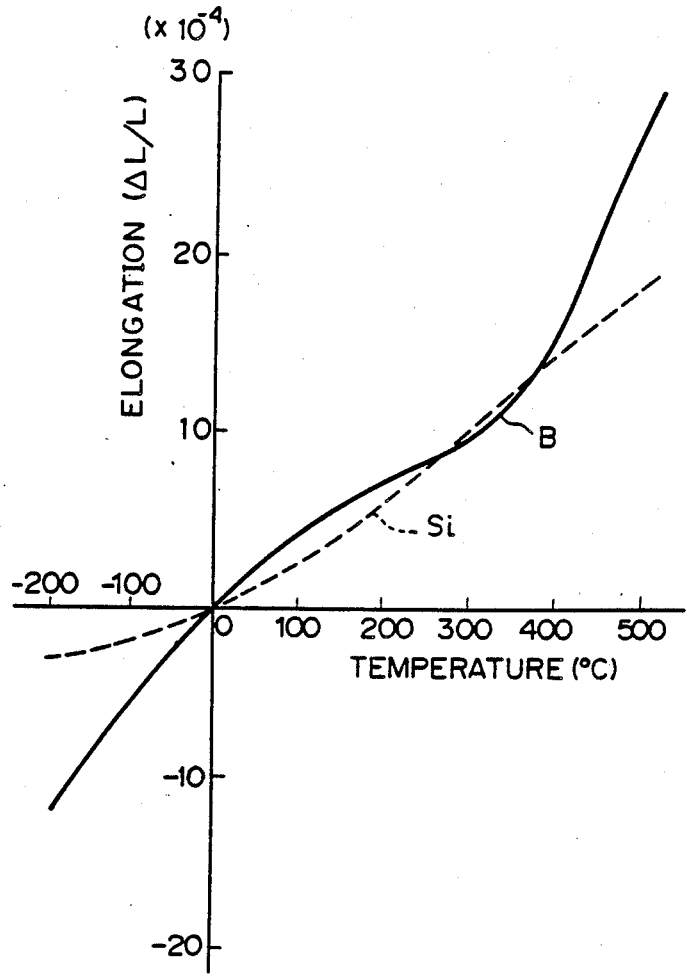
FIG. 2 is a graph for showing elongations of a lowly expansible alloy B and Si.
Figure 3:
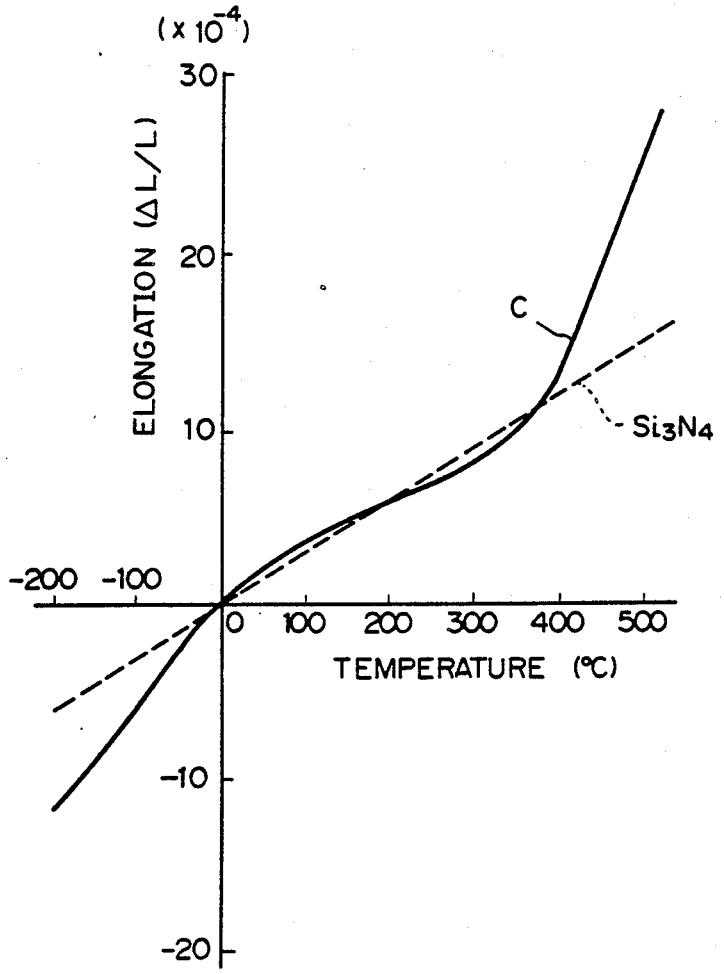
FIG. 3 is a graph for showing elongations of a lowly expansible alloy C and $Si_3N_4$.

In FIG. 1, elongations of the alloy plate A at various temperatures are shown in comparison with those of SiC. In FIG. 2, elongations of the alloy plate B at various temperatures are shown in comparison with those of Si. In FIG. 3, elongations of the alloy plate C at various temperatures are shown in comparison with those of $Si_3N_4$.

Figure 5:
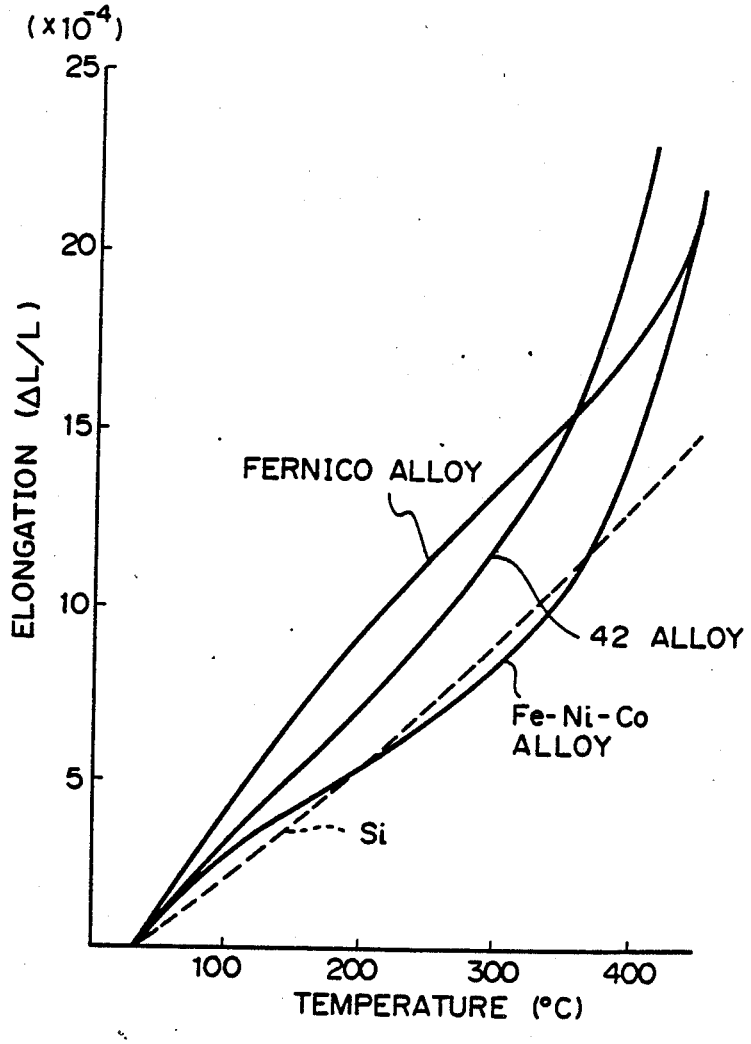
Fig. 5 PRIOR ART
FIG. 5 is a graph for showing elongations of conventional lowly expansible alloys and Si.
Figure 6:
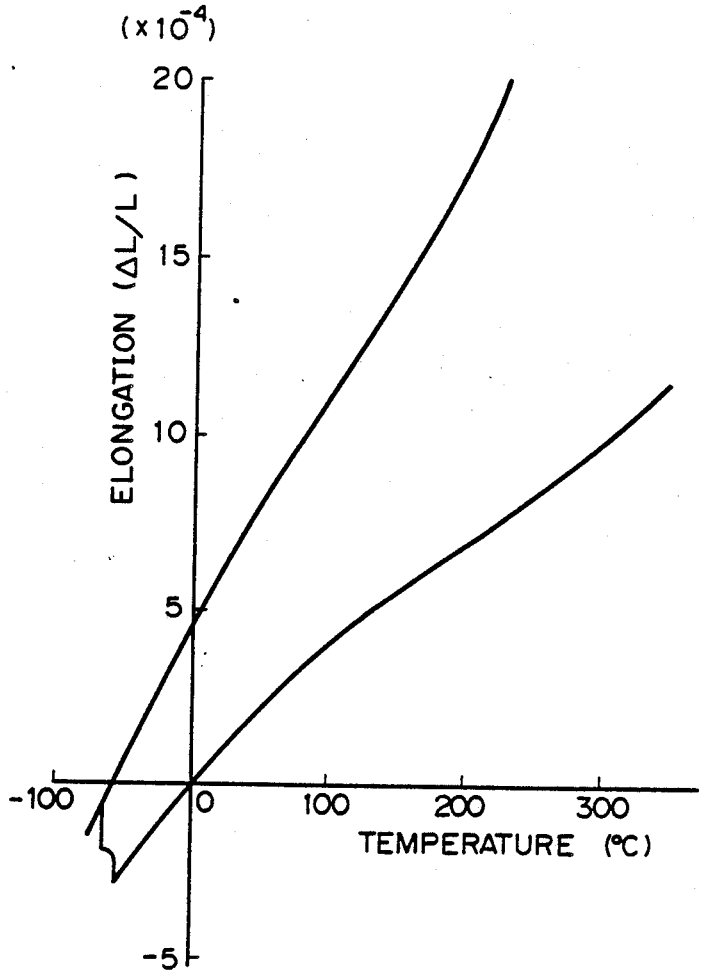
Fig. 6 PRIOR ART
FIG. 6 is a graph for showing changes in elongation following transformation of the lowly expansible Fe-Ni-Co alloy.

When the graphical data in FIGS. 1 to 3 are compared with those in FIG. 5, it is clearly learned that elongations of the alloy plates A, B and C are by far closer to those of Si, SiC or $Si_3N_4$ than the conventional alloys. As a consequence, even when placed in a hard situation spanning high and low temperature ranges, the alloys of the present invention do not allow lead frames made thereof to exhibit large elongation by thermal expansion. In addition, since the elongations are quite close to those of Si, SiC or $Si_3N_4$, no virtual thermal stress is imposed on the silicon chips in the integration circuit.

Figure 4:
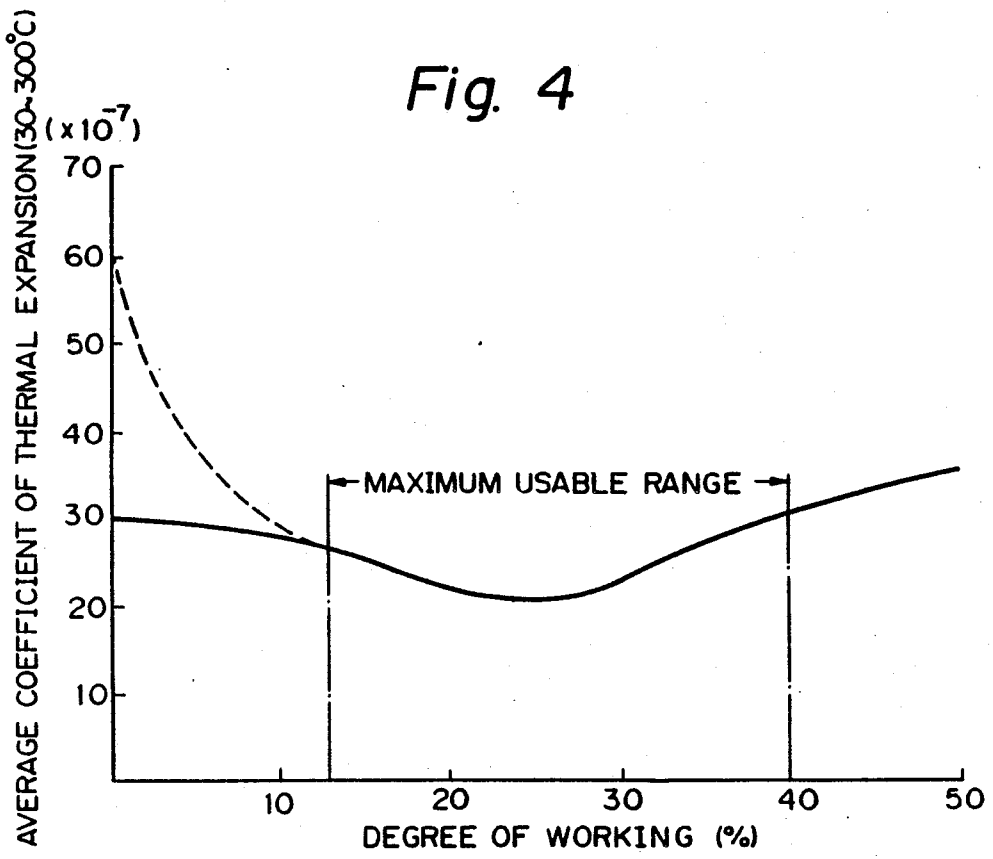
FIG. 4 is a graph for showing the relationship between the degree of working and the coefficient of thermal expansion.

In FIG. 4, dependency of the average coefficient of thermal expansion on the degree of working applied to the alloy plate C is shown with a solid line. A dot line indicates the dependency of the average coefficient of thermal expansion on the degree of working applied to the alloy plate C which was cooled for 10 minutes at −196° C., degree of working being below 13%.

As is clear from FIG. 4, the average coefficient of thermal expansion starts to increase at 40% degree of working. In the case of the alloy cooled at −196° C., the average coefficient of thermal expansion starts to increase significantly at 13% degree of working. This results warrant the limitation of the degree of working to the range from 13 to 40%.

Figure 7:
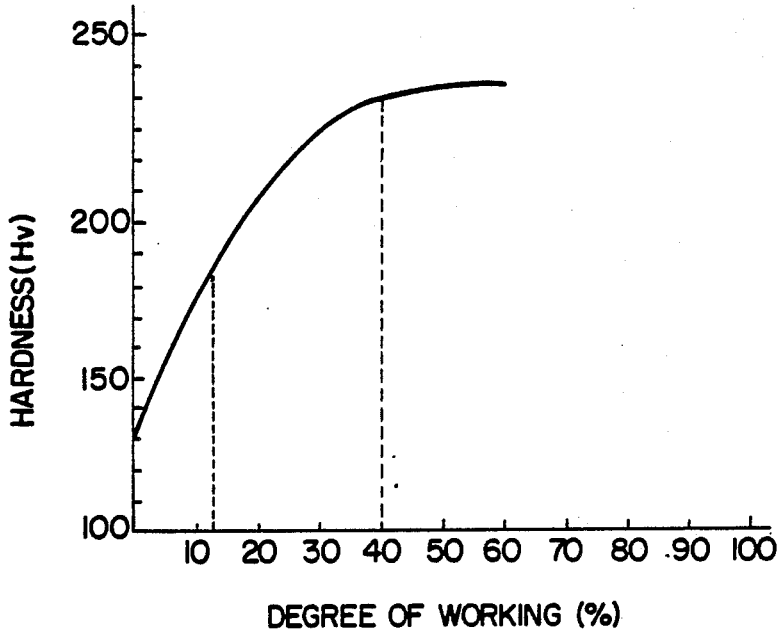
FIG. 7 is a graph for showing the dependency of the resultant hardness on the degree of working.

FIG. 7 depicts the dependency of the resultant hardness (Hv) on the degree of working (%) as applied to an alloy plate of type C in Table 1. To obtain the technical data utilized to generate the graph in FIG. 7 alloy plates of type C in Table 1 were heated at 1,000° C. for one minute and then cooled abruptly. Next, sample plates of 0.15mm were prepared at various degrees of working. Each sample plate was then subjected to annealing in which heating was carried out at 620° C. for one minute for measurement of the hardness (Hv).

Thus, FIG. 7 merely verifies the range of degree of working on the hardness chosen from data such as that provided in FIG. 4, discussed above. Accordingly, FIG. 7 shows that a 13% degree of Working of the alloy yields a product of about 180 Hv, a particularly desirable level of hardness for an alloy to be used in the production of lead frames for semiconductor integration circuits. The upper limit of a 40% degree of working is chosen from the data in FIG. 4 showing that any degree of working about 40% would cause large thermal expansion. FIG. 7 shows the result of thermal expansion above a 40% degree of working on the hardness. Additionally, those skilled in the art will readily recognize that too high a degree of working develops directionality in the product and, as a consequence, the bending durability of the product in the direction of working is significantly deteriorated.

What is claimed is:

1. A method for producing an alloy having low thermal expansion characteristics comprising preparing an iron-based alloy containing from about 25 to 32 wt. % of nickel, from about 10 to 15 wt. % cobalt, from about 0.1 to 2 wt. % manganese, up to about 1 wt. % silicon, from about 0.001 to 0.5 wt. % carbon, and the balance iron, annealing said iron-based alloy by heating said iron-based alloy at a temperature above the recrystallization point of said iron-based alloy, cooling said annealed iron-based alloy, and subjecting said annealed and cooled iron-based alloy to cold working at between a 13 to 40% degree of working, so that said cold-worked alloy has a hardness (Hv) not substantially lower than 180 and a maximum coefficient of thermal expansion of approximately $35\times10^{-7}$/°C., in the range of 30°–300° C.

2. The method of claim 1 wherein said annealing step is conducted at a temperature of between about 700° and 1,100° C.

3. The method of claim 2 wherein said annealing step is conducted for a period of from about 1 to 240 minutes.

4. The method of claim 1 wherein said cold working comprises cold rolling.

* * * * *